United States Patent [19]

Thorpe

[11] Patent Number: 4,658,521

[45] Date of Patent: Apr. 21, 1987

[54] QUILTING FRAME APPARATUS

[76] Inventor: Vonda J. Thorpe, 1220 W. 4575 North, Brigham City, Utah 84302

[21] Appl. No.: 837,042

[22] Filed: Mar. 6, 1986

[51] Int. Cl.[4] ..... D06C 3/08; D06C 3/10

[52] U.S. Cl. ..... 38/102.6; 38/102.91; 248/188.9

[58] Field of Search ..... 38/102.9, 102.91, 102.6; 248/172, 188.9, 188.8, 677; 160/383, 398, 404; 242/67.3 F

[56] References Cited

U.S. PATENT DOCUMENTS

| | | | |
|---|---|---|---|
| 341,634 | 5/1886 | Bohlinger | 38/102.6 |
| 487,240 | 12/1892 | Backof | 38/102.91 |
| 1,020,295 | 3/1912 | Lewis et al. | 242/67.3 F |
| 1,484,418 | 2/1924 | Solomon | 38/102.91 X |
| 1,616,563 | 2/1927 | Allen | 38/102.6 |
| 1,923,247 | 8/1933 | Wood | 38/102.9 X |
| 2,812,614 | 11/1957 | Ladyman | 248/188.9 |

FOREIGN PATENT DOCUMENTS

| | | | |
|---|---|---|---|
| 1439190 | 4/1966 | France | 248/188.9 |

*Primary Examiner*—Werner H. Schroeder
*Assistant Examiner*—Andrew M. Falik
*Attorney, Agent, or Firm*—A. Ray Osburn

[57] ABSTRACT

A quilting frame apparatus which can be adjusted to a wide range of quilt sizes and easily disassembled to store or carry. Elongate frame side members are slotted to be fastened together at selected locations to a set of legs, to make frames of selected sizes and shapes. Another slot carries spaced apart spikes, by which the quilt sheets are quickly fastened and detached from the frame.

7 Claims, 12 Drawing Figures

QUILTING FRAME APPARATUS

BACKGROUND OF THE INVENTION

1. Field

The field of the invention is frames for quilting.

2. State of the Art

Quilting has been a very popular and wide-spread activity for a century or more. Decorative designs and patterns, and stitching styles, for quilts abound. Quilt backing sheet materials, fillers and top cover cloths have evolved along with advancing technology and increased influence of the population. But, surprisingly, there is little prior art for quilting frames, which are so essential to the practice of the quilting art. A "sandwich" of backing sheet, filler and cover must be held by the frame, stretched, spread out and elevated to be stitched together. Prior art frames seldom include even legs to elevate the sandwich so that it may be reached to be sewed both upwardly and downwardly through. Instead, chairs or tables are used to prop up the legless frames. Most commonly, the quilting frame consists of four elongate wooden members successively secured together by four C-clamps to form a quilt sized rectangular frame. The C-clamp and elongate slat construction is held together only tenuously. Occasionally, the slats have spaced apart bores along portions of their length, and pegs are used to secure the corners of the frame through these bores. Sometimes, the edges of the quilt sandwich are secured to frames by direct tacking. More often, the quilting sheets are pinned or tack-stitched to a muslin strip stapled or tacked along each frame member. Most quilts must be stitched a portion at a time, as they are too large to be reached all over from their edges. The frames must be partially disassembled, a portion of the sandwich rolled upon one of the side members, and the frame then reassemble all to place another strip within arms' reach. During this, the frames often come apart and must be completely reassembled. The quilt sheets must often be partially detached to permit the rolling—and then reattached of course.

One prior art frame utilizes a pair of circular rods for two opposing sides of the frame. These are mounted rotatably to the other two sides members. Two opposite edges of the quilting sheets are secured to the rotatable rods. The quilt sandwich is rolled onto one rod and unrolled from the other to provide successive working strips within arms' reach. Clamps and the like must be provided, so that the quilt can be kept taut. The rods must in fact be mounted on a separate unitary frame with cross bracing members, increasing the expense. It is not easily broken down for storage or transportation. Sometimes, ratchets are used, further adding to the complexity and expense. The quilting sheets cannot be attached directly to the side members. For cross-wise tension, lacing strips may be pinned to the sides of the quilt sandwich and wound around the side members. The strips must be removed when the quilt is rolled upon the rods, and then laced again before quilting is resumed. These roll frames are apparently not adjustable to accommodate quilts of various sizes.

None of the prior art frames provide for easy detaching and attaching the quilt sheets. None can be adapted readily to a wide range of quilt sizes and proportions. The only type with legs is unfortunately complex and expensive and also lacking in adjustability.

BRIEF SUMMARY OF THE INVENTION

With the foregoing in mind, the disadvantages in prior art quilting frames are eliminated or substantially alleviated in the present invention, which provides a quilting frame formed by side members held together at each corner by a wing nut and washer upon a bolt secured to extend upwardly from a leg. Adjustment for differently sized and shaped quilts is made by use of elongate slots in each side member through which the leg bolts extend. A second elongate slot in each side member carries a series of spaced apart horizontal spikes for readily attaching the quilting sheets. To accommodate a wide range of quilt sizes, and to provide frame portability and compact storability, each side member preferably comprises one or more reduced length segments along with readily connected and disconnected segment coupling means. The coupling means may each comprise an open ended sleeve to frictionally accept the two butting ends of the coupled segments. Slots may be provided through the coupler sleeves for access to the leg bolt and quilt attachment slots. According to one embodiment of the invention, only the quilt attachment slot is provided, and is utilized also as the leg bolt slot.

It is therefore the principal object of the invention to provide a quilting frame which may be readily assembled in desired sizes and shapes, and as readily disassembled for storage and portability, and which also provides for quick attachment and detachment of the quilting sheets.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figures 1, 2:
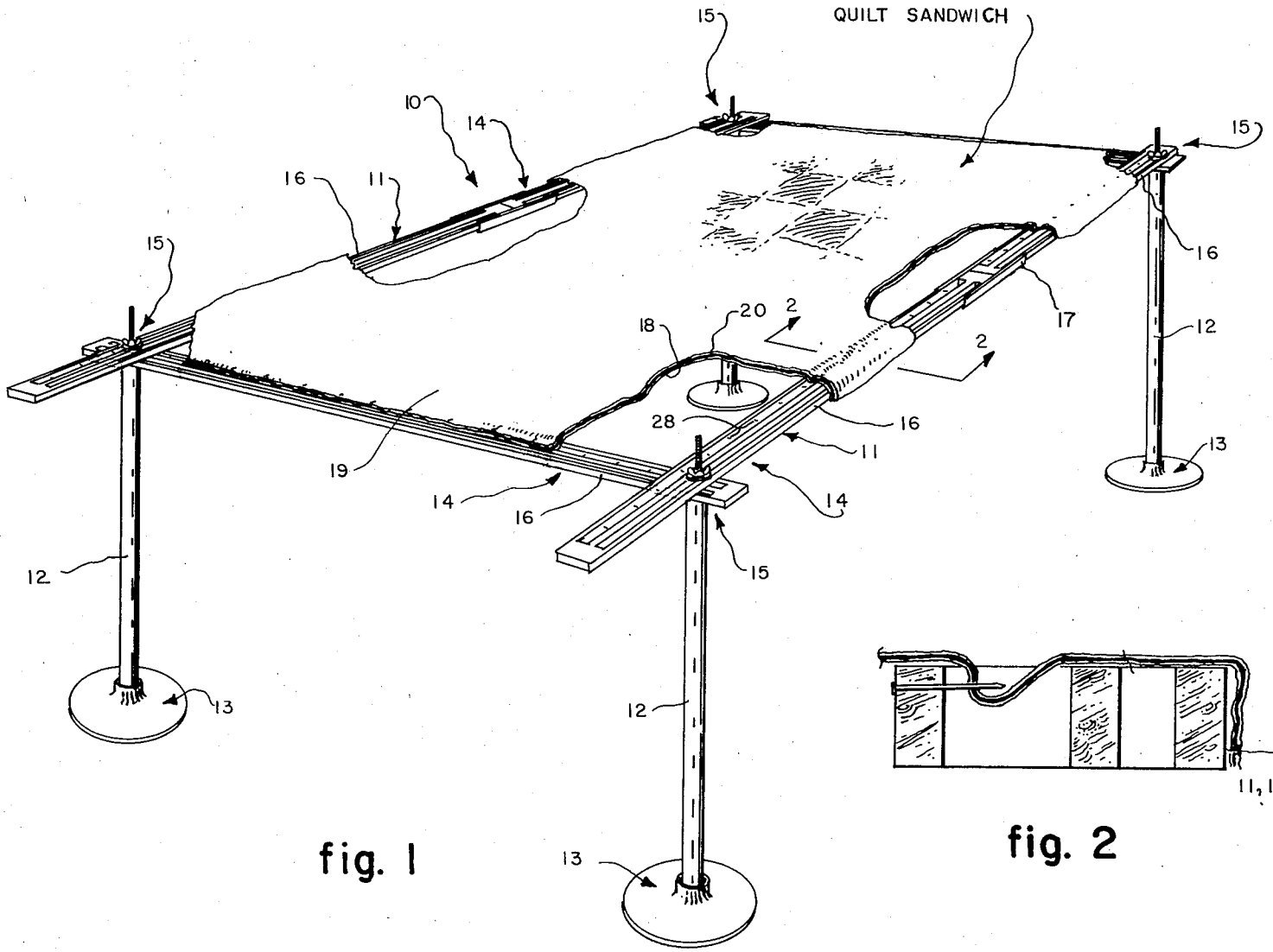
FIG. 1 is a perspective view of a quilting frame apparatus in accordance with the invention, drawn to a reduced scale, the quilt sandwich being illustrated attached thereto cut away to show details of the quilting frame apparatus.
FIG. 2 a vertical cross sectional view of one of the side frame members of the apparatus showing the mode of attachment of the quilt sandwich thereto, taken along line 2—2 of FIG. 1, drawn to a larger scale.
Figure 3:
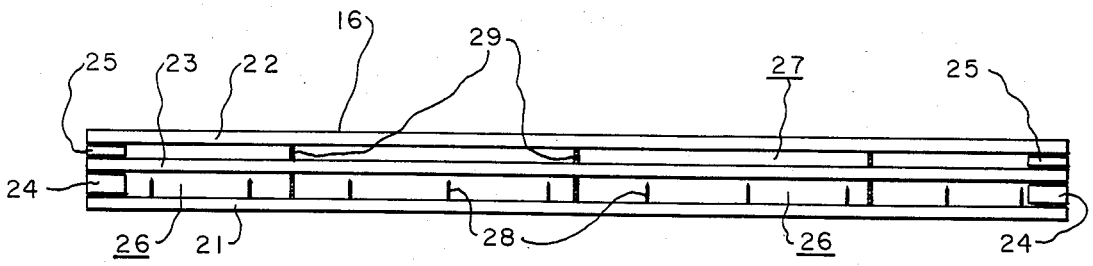
FIG. 3 a plan view of one of the side frame segments, drawn to a somewhat larger scale than the scale of FIG. 1.
Figure 4:
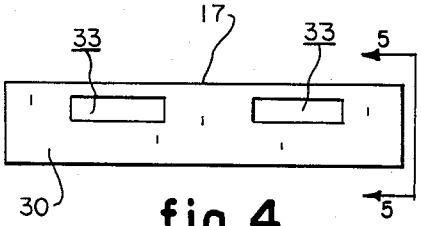
FIG. 4 a bottom view of one of the segment couplers, drawn to a somewhat larger scale than that of FIG. 3.
Figure 5:
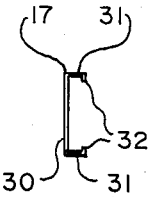
FIG. 5 an end view of the segment coupler of FIG. 4, taken along line 5—5 thereof, drawn to the same scale.
Figure 6:
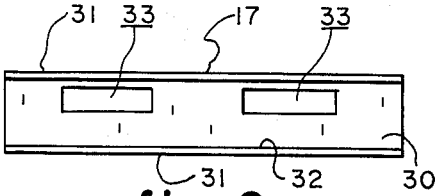
FIG. 6 a top plan view of the segment coupler of FIG. 4, drawn to the same scale.
Figure 7:
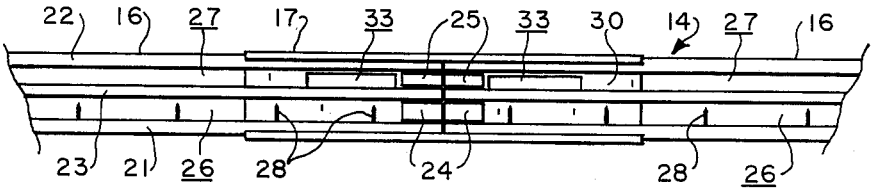
FIG. 7 a plan view of fragments of two ends of frame segments joined together by the coupler of FIG. 4, drawn to the scale of FIG. 4.

Quilting apparatus 10 comprises a frame 11, supported above the floor upon legs 12 to let the quilter reach to stitch through a quilt sandwich both downwardly and upwardly. (FIG. 1) Leg base members 13 may be employed advantageously for improved stability. The illustrated rectangular frame 11 is made up of four side members 14 secured serially together at successive legs 12 to form frame corners 15. Each side member 14 of frame 11 comprises one or more frame segrents 16, frictionally coupled axially together by a sleeve 17 when two or more segments are employed. Rectangular frame 11 is adjustable to accommodate a wide range in sizes and proportions of quilts. The number of segments 16 used determines the gross size and shape of frame 11. Finer adjustments are made by selective utilization of portions of segments, as later fully explained. (FIG. 1)

Quilt backing sheet 18 and top sheet 19, with the filler layer 20 sandwiched between, are all secured stretched between opposing members 14. The quilt is then completed, except for final treatment of its edges, by stitching upwardly and downwardly through the three layers across their expanse. Some quilters may prefer to baste stitch the filler and top layers 19 and 20 temporarily about their peripheries to a slightly larger backing sheet 18. The quilt sandwich is then secured to frame 11 only by backing sheet 18.

Each frame segment 16 comprises elongate strips 21, 22 and 23, held apart at their ends by spacers 24 and 25 to create a pair of slots 26 and 27, respectively near the inside and outside of frame 14. The outside slots 27 are used for securing the frame members 14 to the legs 12, as subsequently explained in more detail herein.

Inside strip 21 carries spaced apart spikes 28 extending into slot 26 for attachment of the quilt sandwich to frame 11. (FIG. 2) Layers 18, 19 and 20 of the quilt sandwich are all impaled together upon the spikes 28. They are thus easily and quickly attached and released from frame 11. Spikes 28 are readily accessible but do not extrude dangerously above or below frame segment 16. Small nails serve very well for spikes 28, driven through inside strip 21 when wood is employed for frame 11, or moulded into plastic versions, for example. To provide increased lateral rigidity of the segments 16, one of more spacers, such as the illustrated threaded nails 29, may be used to hold the three strips spaced apart.

For larger frames 11, two or more segments 16 are secured end to end as by a coupling sleeve 17, preferably formed of thin malleable sheet metal. Channel-shaped coupler 17 comprises a web 30 and a pair of upstanding flanges 31, each with an inturned lip 32. Web, flanges and lips frictionally grip the abutting ends of the joining segments 16. A pair of elongate slots 33 through web 30 match inside slot 26 of segment 16 for minimal compromise to selection of quilting frame size. (FIGS. 4–7)

Figure 8:
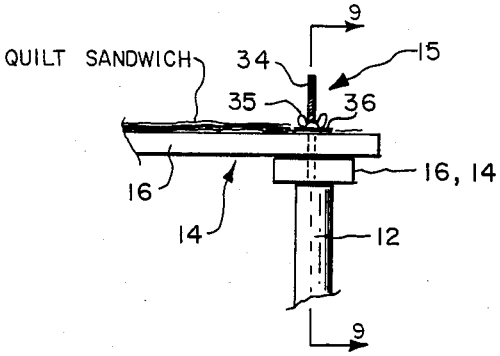
FIG. 8 an elevation view of a fragment of the frame of FIG. 1, including one corner thereof, drawn to an enlarged scale.
Figure 10:
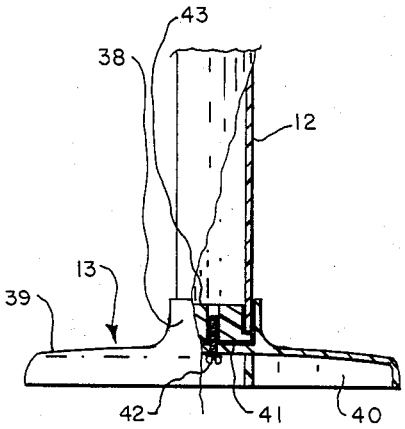
FIG. 10 an elevation view of one of the enlarged leg bases, partially cut away, drawn to the approximate scale of FIG. 9.
Figure 9:
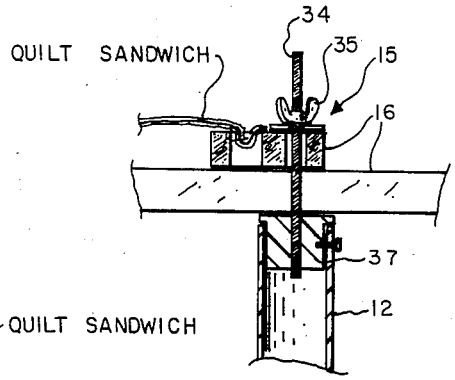
FIG. 9 a vertical cross sectional view of the frame corner of FIG. 8, taken along line 9—9 thereof, drawn to an enlarged scale.

At each corner 15 of frame 11, a pair of segments 16 is joined by a threaded bolt 34 upstanding from one of the legs 12. Leg bolt 34 extends through outside slot 27 of the two joining segments 16, wing nut 35 and washer 36 securing them together upon leg 12. The exact desired frame size and shape may thus be selected. (FIGS. 8 and 9)

For increased frame stability, large area shoes 13 may be provided at the bottom of each leg 12. Shoe 13 may comprise a leg sleeve 38, a circular base 39 with stiffening ribs 40 and a mounting bore 41, and a shoe mounting screw 42, the latter engaging a threaded bore 43 in lower leg insert 37.

Figure 11:
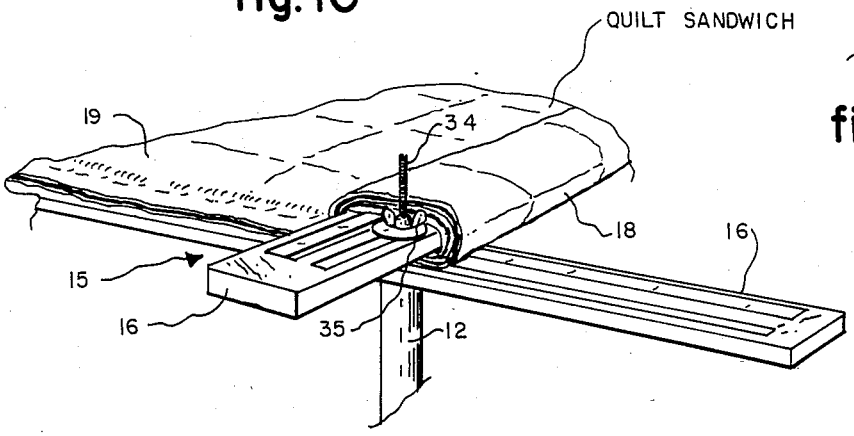
FIG. 11 a perspective view of a corner fragment of the apparatus of FIG. 1, showing the quilt sandwich rolled upon a side member in preparation for quilting a further portion of the quilt sandwich, drawn to the approximate scale of FIG. 9.

For quilts too large to be reached all over, a portion may be stitched and frame 11 then adjusted to provide access to another portion. A pair of the wing nuts 35 are removed from the leg bolts 34, releasing a side 14 with the quilt sandwich still secured to it by the spikes 28. A portion of the quilt sandwich is rolled onto member 14, and the detached pair of legs 12 slided along outside slots 27 to be reattached to the side member 14. A successive portion of the quilt is then within reach for further work. (FIG. 11)

Figure 12:
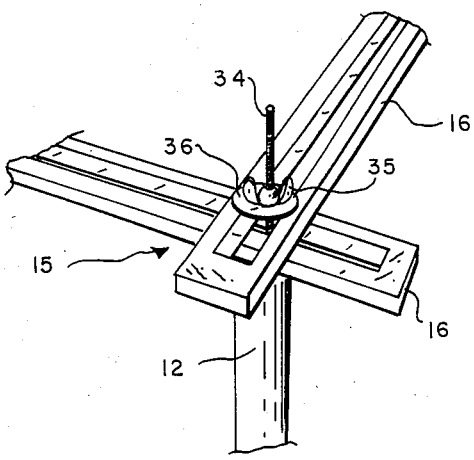
FIG. 12 a corner fragment of another embodiment of the invention wherein the side members carry a single slot for frame assembly and quilt sandwich attachment, drawn to the approximate scale of FIG. 11.

In the preferred embodiment of quilting apparatus 10, separate quilt attaching and frame securing slots 26 and 27 are provided. This is advantageous in that the leg bolts 34 are located away from the edge of the quilting layers, which facilitates the roll up described above. However, it is within the spirit of the invention to provide only a single, perhaps widened, slot 26 for both attachment of the quilting sheets and assembly of frame 11. (FIG. 12) Other features than those shown may be employed without departing from the spirit of the invention. For example, segment 16 could be constructed with telescoping ends for attachment together, or with friction pins and matching bores for the same purpose. Also, the bolt and wing nut could be replaced by other means for removably securing the side members to the legs.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

What is claimed and desired to be secured by United States Letters Patant is:

1. A quilting frame apparatus comprising:

a plurality of elongate frame side members, each having a pair of parallel slots therethrough substantially its full length, one of said slots having spaced apart spikes therewithin extending from the side of said slot nearest the side of the side member towards the opposite side of said slot;

a corresponding plurality of elongate leg members, each carrying an axially aligned, threaded bolt extending therefrom at its upper end; so that said side members may be selectively joined together to the leg members by use of the leg bolts extending through the other of the pair of slots, to form a multi-sided quilting frame elevated from a floor.

2. The quilting frame apparatus of claim 1, wherein:

at least one side member comprises at least two segments and coupling means securing the segments together to provide the required side member length.

3. The quilting frame apparatus of claim 2, wherein the coupling means comprises:

open ended sleeve means shaped and sized to accept a portion of an end of each of two side frame segments frictionally therein in axial alignment with each other.

4. The quilting frame apparatus of claim 2, wherein:

each coupling sleeve is apertured to permit utilization of the spike carrying slot and the leg bolt slot a substantial portion of the full length of said sleeve.

5. The quilting frame apparatus of claim 4, further comprising:

floor contacting shoe means removably secured to the lower end of each leg, said shoe means having a floor-contacting surface of substantially greater area than the cross section of the leg member.

6. A quilting frame apparatus comprising:

a plurality of elongate frame side members, each member having a slot therethrough substantially the full length thereof, said member having a series of spaced apart spikes outstanding from one side of the slot toward the opposite side thereof;

a matching plurality of elongate leg members each having at its upper end an axially aligned threaded bolt secured thereto, so that the side members may be connected serially tógether and to the legs by the leg bolts extending through the slots of two joining side members to provide a multi-sided quilting frame elevated from a floor; wherein at least two of the side members comprises at least two segments along with means coupling them axially together; wherein the coupling means comprises open-ended sleeve means shaped and sized to frictionally retain therein a portion of the abutting ends of the two segments axially aligned; and each sleeve is cut away a substantial poriton ot its full length to permit utilization of the spike bearing slot.

7. The quilting frame apparatus of claim 6, further comprising:

foot means detachably secured to the end of each leg member, said foot means having substantially greater ground bearing surface than that of the leg member.

* * * * *